United States Patent [19]

Chen

[11] Patent Number: 4,514,715

[45] Date of Patent: Apr. 30, 1985

[54] SAFETY RECEPTACLE

[76] Inventor: Kun S. Chen, No. 3, Alley 3, Lane 418, Hsin-Hsing Rd., Tainan City, Taiwan

[21] Appl. No.: 610,525

[22] Filed: May 15, 1984

[51] Int. Cl.[3] ..... H01H 61/01; H01H 71/08

[52] U.S. Cl. ..... 337/113; 337/381

[58] Field of Search ..... 337/113, 381, 112

[56] References Cited

U.S. PATENT DOCUMENTS

| | | | |
|---|---|---|---|
| 1,955,076 | 4/1934 | Ludwig | 337/113 |
| 2,508,637 | 5/1950 | Bolesky | 337/113 |
| 2,783,329 | 2/1957 | Jackson | 337/113 |
| 4,347,494 | 8/1982 | Krasser | 337/113 |

*Primary Examiner*—Harold Broome

*Attorney, Agent, or Firm*—Lowe King Price & Becker

[57] ABSTRACT

A safety receptacle having bimetallic means which will cut off the power line when an electrical appliance connected thereto is overloaded or short-circuited. Further, the safety receptacle may be slightly modified to form a circuit breaker or a safety plug.

8 Claims, 10 Drawing Figures

SAFETY RECEPTACLE

BACKGROUND OF THE INVENTION

The commonly used devices for preventing excessive voltages and current from overloading and damaging an electrical circuit are fuses and circuit breakers. However, fuses can only cope with general overload conditions. Furthermore, replacement after "blowing" a fuse entails threading a new piece of wire between the fuse terminals. Not only is this a cumbersome process, but also the wire must be strong enough to withstand the handling. Although circuit breakers can be reset, they are prohitively costly. Usually, a circuit breaker is used to control several sets of receptacles. Thus, the breaker will be actuated to break the circuit even if one of the receptacles is short-circuited. However, the circuit breaker does not indicate which one of the receptacles is short-circuited, so that it is necessary to take time to find out the short-circuited receptacle.

It is, therefore, an object of the present invention to provide a safety receptacle which may obviate the above-mentioned drawbacks.

SUMMARY

It is the primary object of the present invention to provide a receptacle which will automatically eject the plug connected thereto to interrupt the flow of current from the power supply when the current becomes excessive and/or the load connected with the receptacle is short-circuited.

It is another object of the present invention to provide a receptacle the output terminals of which will not connect with the power line unless a plug is inserted therein.

It is still another object of the present invention to provide a receptacle which may still firmly keep a plug therein even after long-term use.

It is a further object of the present invention to provide a receptacle which is simple in structure.

Other objects and merits and a fuller understanding of the present invention will be obtained by those having ordinary skill in the art when the following detailed description of the best mode contemplated for practicing the invention is read in conjunction with the accompanying drawings wherein like numerals refer to like or similar parts and in which:

DETAILED DESCRIPTION OF THE PREFERRED EMBODIMENTS

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
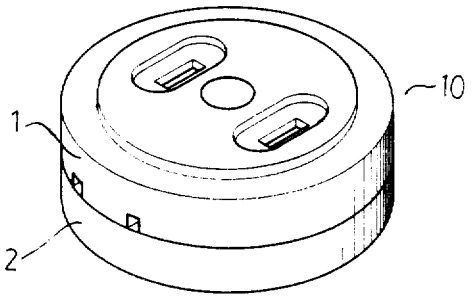
FIG. 1 is a perspective view of a safety receptacle embodying the present invention.
Figure 2:
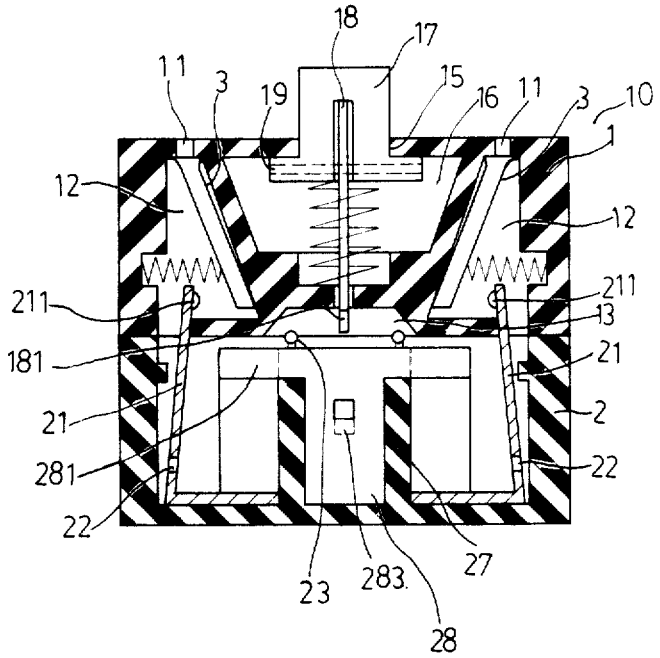
FIG. 2 is a cross-sectional view of the safety receptacle of FIG. 1.
Figure 3:
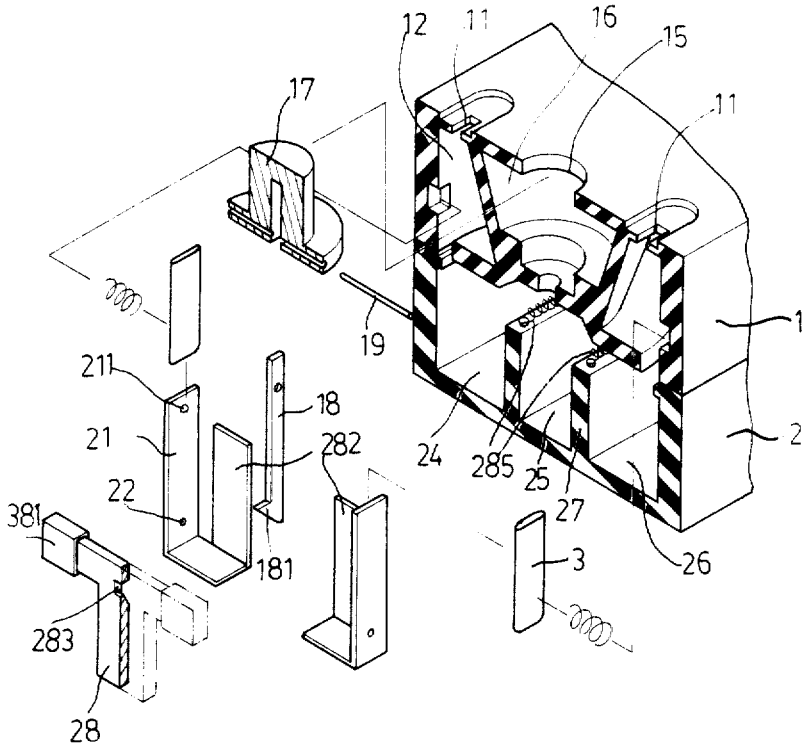
FIG. 3 is a fragmentary perspective view of the safety receptacle of FIG. 2.

With reference to the drawings and in particular to FIGS. 1, 2 and 3 thereof, the safety receptacle according to the present invention comprises a casing (10) made of insulated material such as, for example, plastic or porcelain, etc. The casing (10) consists of an upper part (1) and a lower part (2) which are joined together in a known manner. Further, the casing (10) comes with two chamers (12). The upper part (1) is provided on its top with two slots (11) respectively communicating with the two chambers (12). Inside each of the two chambers (12) is mounted a spring-loaded sleeve (3) preferably made of copper. The sleeves (3) are elliptical in cross-section. Normally, the sleeves (3) are disposed at an angle. As a plug (5) is inserted therein, the sleeves (3) will be forced by the prongs (51) of the plug (5) to dispose at a generally vertical position. Between the two slots (11) there is a hole (15) communicating with a cavity (16) in which is mounted a spring-loaded cap (17) which may extend out of the upper part (1) through the hole (15). Normally, the cap (17) is pressed into the casing (10). A push rod (18) is secured at its lower end to the cap (17) by a pin (10) so that the push rod (18) can be moved in unison with the cap (17). The lower part (2) of the casing (10) is divided into a middle chamber (25) and two side chambers (24) and (26) by two partitions (27). In each one of the chambers (24) and (25) is mounted a conducting plate (21) having a hole (22) served to connect with a wire of an electrical cord. The conducting plate (21) is welded to a bimetallic strip (282) which, when heated, will move outward with respect to FIG. 2. A T-shaped sliding plate (28) is disposed into the chamber (25) in such a way that its flanges (281) are located in front of the bimetallic strips (282). Each flange (281) of the T-shaped sliding plate (28) is preferably provided with an insulated lining (381). A hole (283) adapted to connect with hook portion (181) of the push rod (18) is provided on the T-shaped sliding plate (28). The T-shaped sliding plate (28) is formed at the top with two protuberances (23) each connected with a spring (285) which is attached to rear wall (30) of the casing (10) at its the other end. When heated, the bimetallic strips (282) will be deformed to push the T-shaped sliding plate (28) outwards with respect to FIG. 2. Each of the conducting plate (21) is provided at its free end with a protuberance (211) which will get into touch with the sleeve (3) only when a plug is inserted therein. Further, as the push rod (18) is pressed by inserting a plug therein, the hook portion (181) of the push rod (18) will engage with the hole (283) of the T-shaped sliding plate (28).

Figure 4:
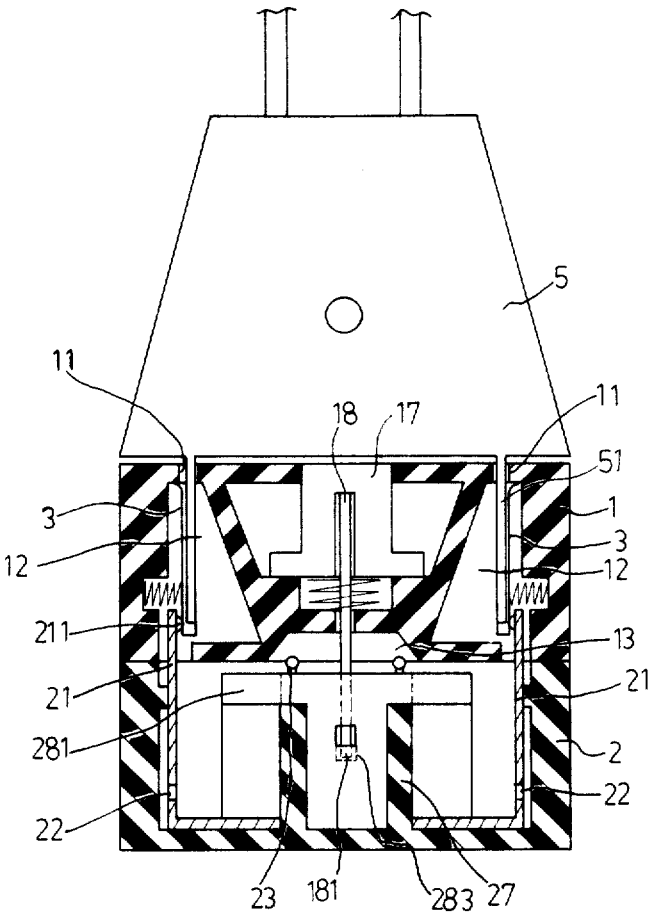
FIG. 4 shows the safety receptacle of FIG. 2, with a plug inserted therein.
Figure 5:
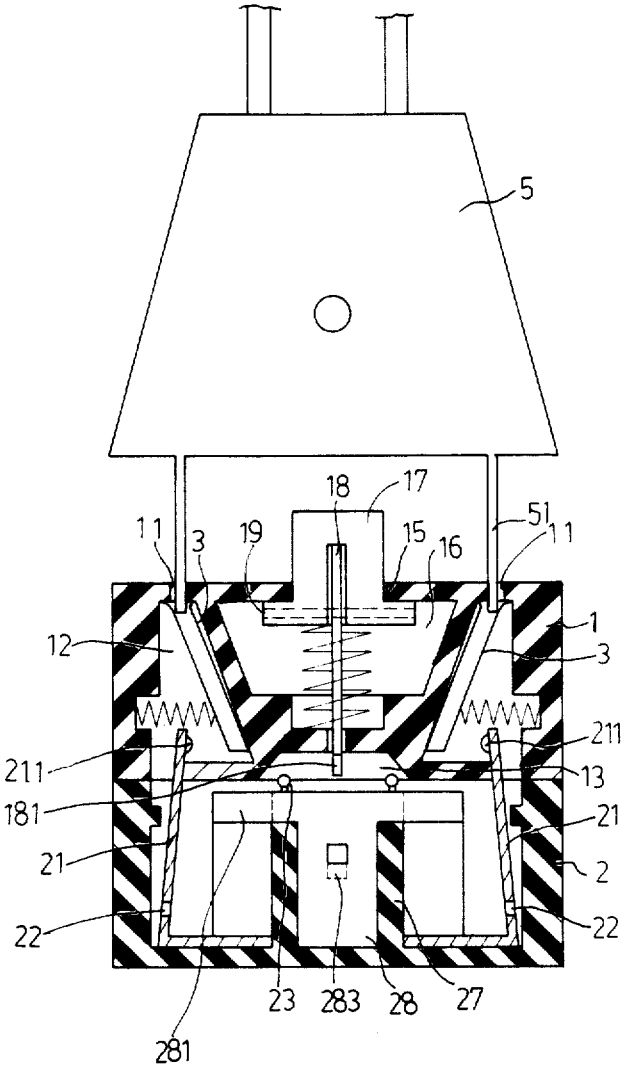
FIG. 5 shows the safety receptacle of FIG. 2, with the plug ejected.

In use, connect the present receptacle to an electrical source (not shown) by connecting each wire of an electrical cord (not shown) with a hole (22) of a conducting plate (21). The present safety receptacle is now in condition for use. Insert plug (5) of an electrical appliance into the present safety receptacle (as shown in FIG. 4). As the plug (5) is inserted into the casing (10) through the slots (11), the sleeves (3) will be forced to dispose vertically, contacting the protuberances (211) of the conducting plates (21). Normally, the cap (17) is pressed downward so that the hook portion (181) of the push rod (18) is engaged with the hole (283) of the T-shaped sliding plate (28). Accordingly, the plug (5) is connected to the electrical power source (not shown) via the present safety receptacle.

Once the electrical appliance connected with the present safety receptacle is short-circuited or overloaded, an excessive current will flow through the bimetallic strips (282) thereby heating the bimetallic strips (282). As a consequence, the bimetallic strips (282) are deformed, which in turn push the T-shaped sliding plate (28) outwards with respect to FIG. 4. Hence, the push rod (18) is disengaged from the T-shaped sliding plate (28) and moved upwards to eject the plug (5) out of the present safety receptacle. In fact, the spring-loaded copper sleeves (3) can help eject the plug (5) out of the casing (10) when the plug (5) is lifted to a certain height. Since the copper sleeves (3) and the sliding plate (28) are spring-loaded, they will return to their original positions at the time the plug (5) is ejected out. Accordingly, the present invention will cut off the power line to the appliance connected with the present safety receptacle when the receptacle is over-loaded or the appliance is short-circuited, thereby providing protection for the appliance.

Figure 6:
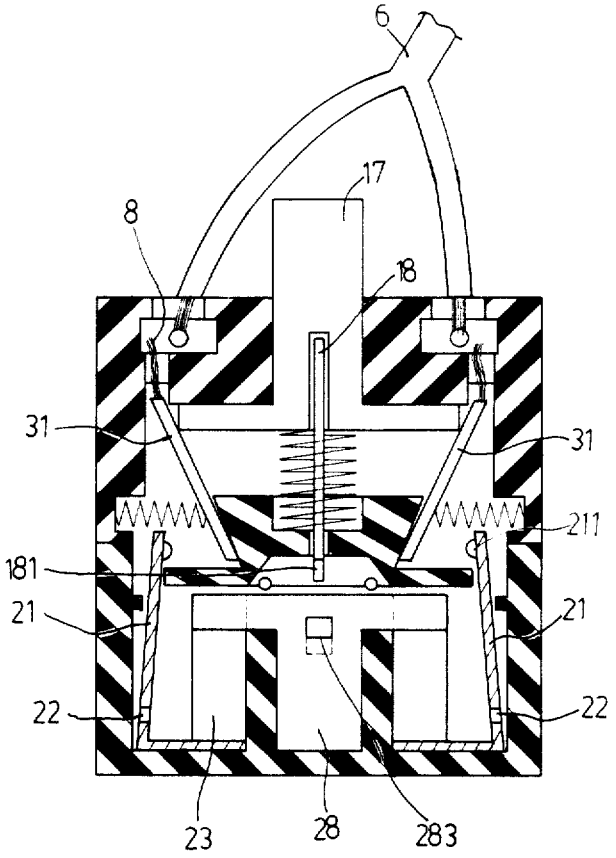
FIG. 6 is a cross-sectional view showing a second preferred embodiment of the present invention.

Turning to FIG. 6, there is shown a second preferred embodiment of the present invention. As can be seen, the conducting plates (21), the bimetallic strips (282) and the sliding plates (28) are substantially the same as those described with reference to FIG. 3, and so need not be described any longer. Two plates (31) are served to replace the copper sleeves (3) of FIG. 3 and connected with an electrical cord (6). The bottom of cap (17) is enlarged so that it can force the plates (31) to be in contact with the protuberances (211) of the conducting plates (21). Each of the conducting plates (21) has a hole (22) for connecting a wire of an electrical cord (not shown). To switch on the present invention, simply press the cap (17), forcing the plates (31) to contact the protuberances (211) of the conducting plates (21) and pushing the push rod (18) downward to engage with the hole (283) of the T-shaped sliding plate. As the load (not shown) connected with the terminals (8) is overloaded or short-circuited, an excessive current flows through the bimetallic strips (282) thereby heating the bimetallic strips (282). Accordingly, the metallic strips (282) are deformed, which in turn push the T-shaped sliding plate (28) outwards with respect to FIG. 6. Hence, the push rod (18) is disengaged from the T-shaped sliding plate (28), thus lifting the cap (17) and therefore, breaking the circuit. The plates (31) are no longer in contact with the protuberances (211) of the conducting plates (21). Thus, the terminals (8) are disconnected from the conducting plates (21). Consequently, the power line (not shown) connected with the circuit breaker according to the present invention is cut off, thus protecting the load from damage.

Figure 7:
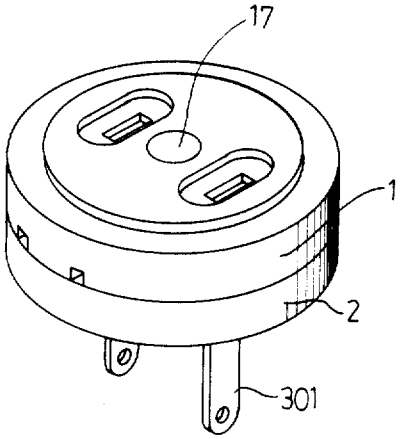
FIG. 7 shows a third preferred embodiment of the present invention.

With reference to FIG. 7, there is shown a third preferred embodiment of the present invention. As shown, the safety receptacle is further provided with two prongs (301) respectively connected with the two conducting plates so that it may be inserted into a commonly used receptacle. In other words, the present invention may be used with prior art receptacles and so it is unnecessary to dismantle the known receptacles already installed.

Figure 8:
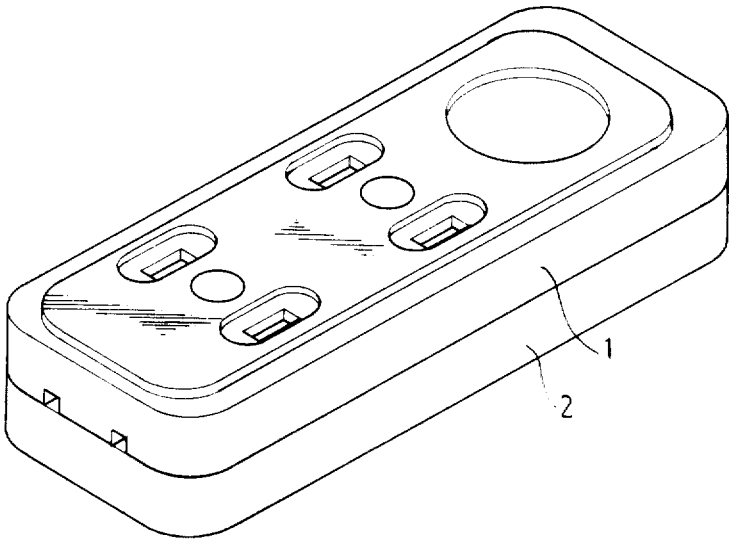
FIG. 8 shows a fourth preferred embodiment of the present invention.
Figure 9:
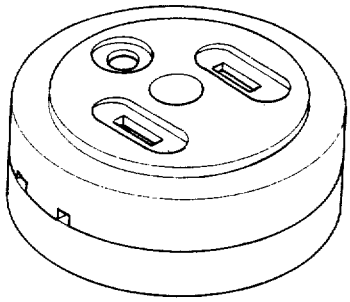
FIG. 9 shows a fifth preferred embodiment of the present invention.
Figure 10:
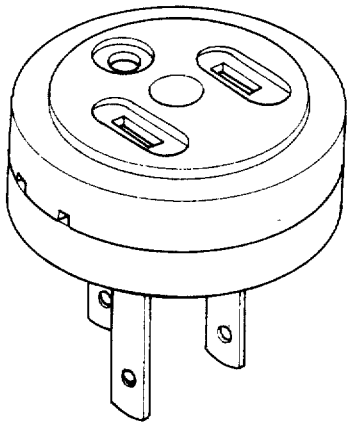
FIG. 10 shows a sixth preferred embodiment of the present invention.

It is noted that the present invention may be modified to form a safety receptacle capable of connecting with two plugs (as shown in FIG. 8). Similarly, the present invention may further be modified to form a receptacle as shown in FIG. 9 or a plug as shown in FIG. 10.

Although this invention has been described with a certain degree of particularity, it is understood that the present disclosure has been made by way of examples only and that numerous changes in the detail of construction and the combination and arrangements of parts may be resorted to without departing from the spirit and scope of the invention as hereinafter claimed.

I claim:

1. A safety receptacle, comprising:

a casing having an upper part and a lower part joined to the upper part, said upper part being provided on the top with two slots, a hole disposed between the two slots and two chambers, said lower part being provided with a middle chamber and two side chambers;

a spring-loaded cap disposed into said upper part in such a way that the top of the spring-loaded cap may extend through said hole of said upper part;

two spring-loaded sleeves disposed into said upper part, said spring-loaded sleeve being disposed at an angle into each said chamber of said upper part;

a spring-loaded push rod fixedly attached at the bottom of said cap, said push rod having a hook portion at its lower end;

a T-shaped sliding plate mounted into the middle chamber of said lower part, said sliding plate having two flanges and a hole adapted to said hook portion of said push rod;

two conducting plates respectively disposed into said two side chambers of said lower part; and two bimetallic strips respectively welded to said two conducting plates, said two bimetallic strips being positioned behind said two flanges of said T-shaped sliding plate and being capable of pushing said sliding plate to disengage from said push rod when an excessive current flows through said bimetallic strips.

2. A safety receptacle as claimed in clain 1, wherein said flanges of said T-shaped sliding plate are provided with an insulated lining.

3. A safety receptacle as claimed in claim 1, wherein said casing is preferably made of plastic.

4. A safety receptacle as claimed in claim 1, wherein said spring-loaded sleeves are preferably made of copper.

5. A circuit breaker, comprising:

a casing having an upper part and a lower part joined to the upper part, said upper part being provided on the top with two terminals, a hole disposed between the two terminals and two chambers, said lower part being provided with a middle chamber and two side chambers, a spring-loaded cap disposed into said upper part in such a way that the top of the spring-loaded cap may extend through said hole of said upper part;

two spring-loaded plates disposed into said upper part, said spring-loaded sleeve being disposed at an angle into each said chamber of said upper part;

a spring-loaded push rod fixedly attached at the bottom of said cap, said push rod having a hook portion at its lower end;

a T-shaped sliding plate mounted into the middle chamber of said lower part, said sliding plate having two flanges and a hole adapted to said hook portion of said push rod;

two conducting plates respectively disposed into said two side chambers of said lower part; and two bimetallic strips respectively welded to said two conducting plates, said two bimetallic strips being positioned behind said two flanges of said T-shaped sliding plate and being capable of pushing said sliding plate to disengage from said push rod when an excessive current flows through said bimetallic strips.

6. A circuit breaker as claimed in claim 5, wherein said flanges of said T-shaped sliding plate are provided with an insulated lining.

7. A circuit breaker as claimed in claim 5, wherein said casing is preferably made of plastic.

8. A circuit breaker as claimed in claim 5, wherein said spring-loaded plates are preferably made of copper.

* * * * *